US006952865B2

(12) United States Patent
Fransted

(10) Patent No.: US 6,952,865 B2
(45) Date of Patent: Oct. 11, 2005

(54) APPARATUS FOR REMOVING HEAVY DUTY BRAKE DRUM BOLTS

(76) Inventor: Jeff G. Fransted, 6232 King Rd., Spring Arbor, MI (US) 49283

( * ) Notice: Subject to any disclaimer, the term of this patent is extended or adjusted under 35 U.S.C. 154(b) by 56 days.

(21) Appl. No.: 10/675,753

(22) Filed: Sep. 30, 2003

(65) Prior Publication Data

US 2005/0066502 A1 Mar. 31, 2005

(51) Int. Cl.[7] ..... B25R 9/00
(52) U.S. Cl. ..... 29/281.5; 81/13
(58) Field of Search ..... 81/13, 55, 487, 81/488, 177.1, 177.85; 29/281.5, 281.1

(56) References Cited

U.S. PATENT DOCUMENTS 1,431,832 A * 10/1922 Mills et al. ..... 81/13
2,305,274 A 12/1942 Power
4,914,989 A 4/1990 Hendricks et al.
4,920,835 A 5/1990 Hendricks
5,188,008 A 2/1993 States
5,546,834 A 8/1996 Gable et al.
5,727,431 A 3/1998 Wivagg
5,954,466 A * 9/1999 Coffey et al. ..... 81/13
6,817,270 B1 * 11/2004 Tremblay et al. ..... 81/13

* cited by examiner

*Primary Examiner*—Robert C. Watson
(74) *Attorney, Agent, or Firm*—Young & Basile, P.C.

(57) ABSTRACT

The present invention provides a tooling apparatus for aiding in the removal of brake drum bolts on a heavy duty truck or trailer wheel. The present invention provides an elongated primary shaft having a first end and a second end. An intermediate shaft is connected to the second end of the primary shaft. A secondary shaft is connected to the intermediate shaft and has a socket end adaptable to receive a socket for engaging the brake drum bolts. A bearing member is adjustably connected to the primary shaft and adaptable to engage a hole in the truck or trailer wheel for securing the position of the socket on the brake drum bolts.

21 Claims, 3 Drawing Sheets

FIG 1

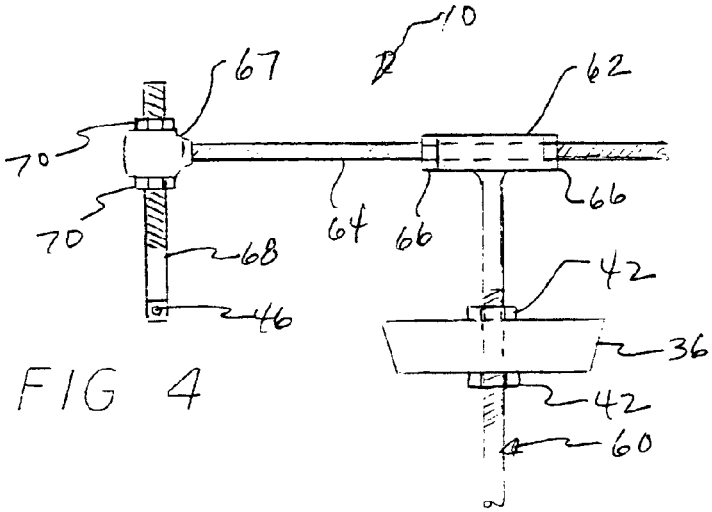
FIG 4
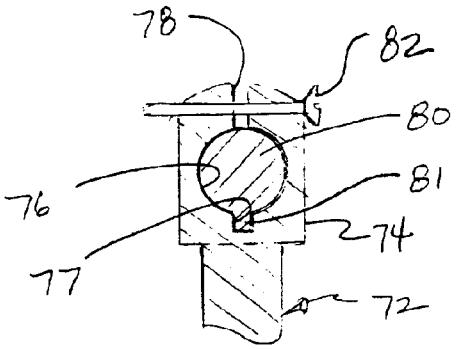
FIG 6
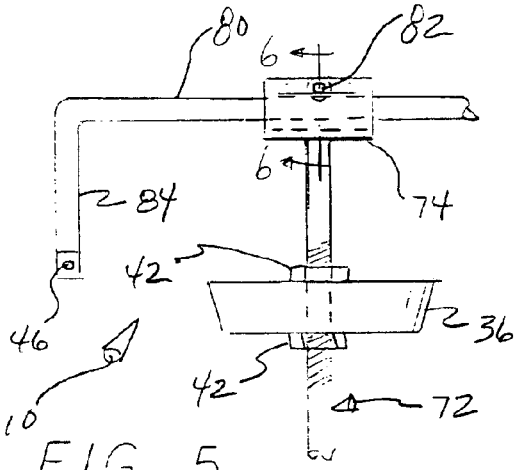
FIG 5
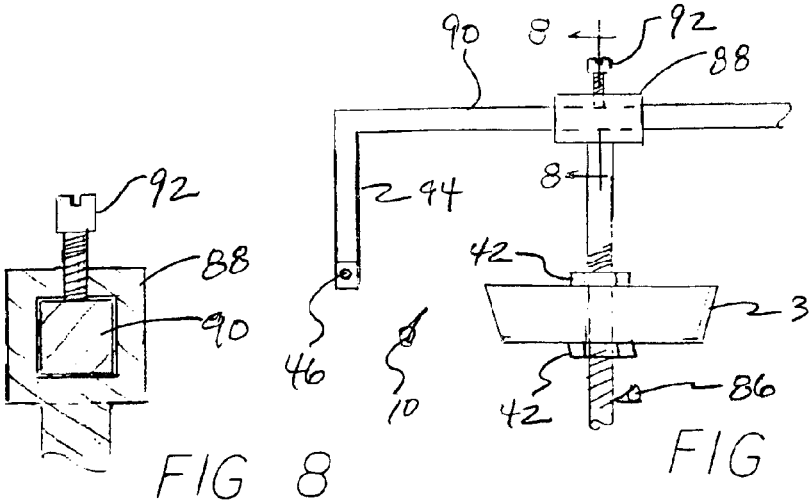
FIG 8
FIG 7

APPARATUS FOR REMOVING HEAVY DUTY BRAKE DRUM BOLTS

FIELD OF THE INVENTION

The present invention relates to an apparatus for aiding in the removal of brake drum bolts from truck and trailer wheels, and more particularly, an apparatus that allows a user to secure a nut to a brake drum bolt on one side of a truck and trailer wheel while loosening the brake drum bolt from the opposite side of the wheel.

BACKGROUND OF THE INVENTION

As a mechanic, performing service on large heavy duty truck and trailer wheels can be difficult. The sheer size of such wheels makes working with and handling the wheels cumbersome and tiring. This difficulty may be compounded when dual wheels are utilized for certain truck and trailer applications. The dual wheels provide a set of wheels that are more than twice as wide as a single wheel.

Heavy duty truck and trailer wheels generally comprise a rubber tire mounted on a steel rim. An apparatus called a spider is bolted to the rim. The spider provides equally spaced legs that extend radially outward from the center-line axis of the wheel. A web extends between each of the legs. The spider has an aperture coaxially aligned with the center-line axis of the wheel in order to allow for the axle of the truck or trailer to extend therethrough. A brake drum attaches to the spider via bolts, and the bolts extend through the webs of the spider and into the brake drum. Brake shoes are mounted to the axle of the truck or trailer and engage the brake drum to slow down and stop the truck and trailer.

When servicing the brakes on a heavy duty truck and/or trailer, it is often necessary to remove the brake drum. To accomplish this, the brake drum bolts must be loosened and removed in order that the brake drum may be disconnected from the spider. Since the brake drum bolts utilize a threaded bolt and a nut, it is necessary to secure the nut on one side of the wheel while loosening the bolt on the opposite side of the wheel. To accomplish this task, the mechanic must reach around both sides of the tire(s) to secure a socket on the nut while ratcheting the bolt loose from the nut. This is a cumbersome and difficult task when handling one wheel; however, it becomes an even more difficult task when handling dual wheels. Therefore, it is sometimes necessary to utilize two mechanics to remove the brake drum bolts from the truck and trailer wheels.

Other attempts have been made to secure the nut on the back side of the wheel while ratcheting the bolt from the front side of the wheel. Vice grips, pliers, wrenches, and other tools have been utilized in an attempt to secure the nut without having a mechanic hold onto the tools. However, upon ratcheting the nut from the opposite side of the wheel, the vibration shakes such tools loose from the nut, thereby preventing the tool from stopping the nut from rotating.

It would be desirable to provide an inexpensive and simple tool that would allow a mechanic to easily and quickly remove brake drum bolts from heavy duty truck and trailer wheels without the aid of a second mechanic. It would also be desirable to provide a tool for removing brake drum bolts from a heavy duty truck or trailer that could be utilized on various size truck and trailer wheels.

SUMMARY OF THE INVENTION

The present invention relates to a tooling apparatus for aiding in the removal of brake drum bolts on heavy duty truck and trailer wheels. The present invention provides an elongated primary shaft having a first end and a second end, wherein an intermediate shaft is connected to the second end of the primary shaft. A secondary shaft is connected to the intermediate shaft and provides a socket end adaptable to receive a socket for engaging the brake drum bolts. A bearing member is adjustably connected to the primary shaft and is adaptable to engage a hole in the wheel for securing the position of the socket on the brake drum bolts. The bearing member may have a frusto-conical configuration for engaging the hole in the wheel and may threadably engage the primary shaft to allow for the adjustment of the bearing member along the longitudinal axis of the primary shaft. At least one jam nut threadably engages the primary shaft and cooperatively engages the bearing member to secure the bearing member in a predetermined position along the primary shaft. The primary shaft may also have a knurled portion formed therein for forming a handle on the first end of the primary shaft. In one embodiment, the primary shaft, intermediate shaft, and secondary shaft may be integrally fabricated.

The present invention also provides various embodiments for adjusting the size of the tooling apparatus. In a second embodiment, the first end and the second end of the primary shaft are releasably connected to one another. In a third embodiment, the intermediate shaft may be adjustably connected to the primary shaft, and the secondary shaft may be adjustably connected to the intermediate shaft. Jam nuts may be utilized on the intermediate shaft and the secondary shaft to secure the positions of the intermediate shaft and the secondary shaft. In a fourth embodiment, the primary shaft may have an aperture and key way formed therein for receiving the intermediate shaft. The intermediate shaft may have a key formed therein for cooperatively engaging the aperture in the key way of the primary shaft. In a fifth embodiment, the primary shaft may have a substantially rectangular throughbore, and the intermediate shaft may have a substantially rectangular cross section wherein the primary shaft receives the intermediate shaft through the throughbore. A set screw threadably engages an aperture in the primary shaft wherein the set screw extends into the throughbore for engaging the intermediate shaft in a predetermined position relative to the primary shaft.

In a sixth embodiment, a plurality of intermediate and secondary shafts are mounted to a primary shaft in order to secure a plurality of brake drum bolts at one time.

In a seventh embodiment, the intermediate shaft may have a throughbore for receiving the secondary shaft and allowing the secondary shaft to rotate with the socket to properly engage the brake drum bolts. A stop may be formed on the intermediate shaft, and the secondary shaft may have a radially-extending portion wherein the radially-extending portion engages the stop to limit the rotational adjustment of the secondary shaft.

BRIEF DESCRIPTION OF THE DRAWINGS

The description herein makes reference to the accompanying drawings wherein like referenced numerals refer to like parts throughout several views and wherein:

FIG. 4 is a front view showing a third embodiment of the tooling apparatus of the present invention.

FIG. 5 is a front view showing a fourth embodiment of the tooling apparatus of the present invention.

FIG. 6 is a sectional view in the direction of arrows 6—6 in FIG. 5 showing the adjustable key way connection between the intermediate shaft and the primary shaft of the tooling apparatus of the present invention.

FIG. 7 is a front view showing a fifth embodiment of the tooling apparatus of the present invention.

FIG. 8 is a cross-sectional view shown in the direction of arrow 8—8 in FIG. 7 showing a substantially rectangular throughbore connection of the intermediate shaft and the primary shaft of the tooling apparatus of the present invention.

DESCRIPTION OF THE PREFERRED EMBODIMENT

Figure 1:
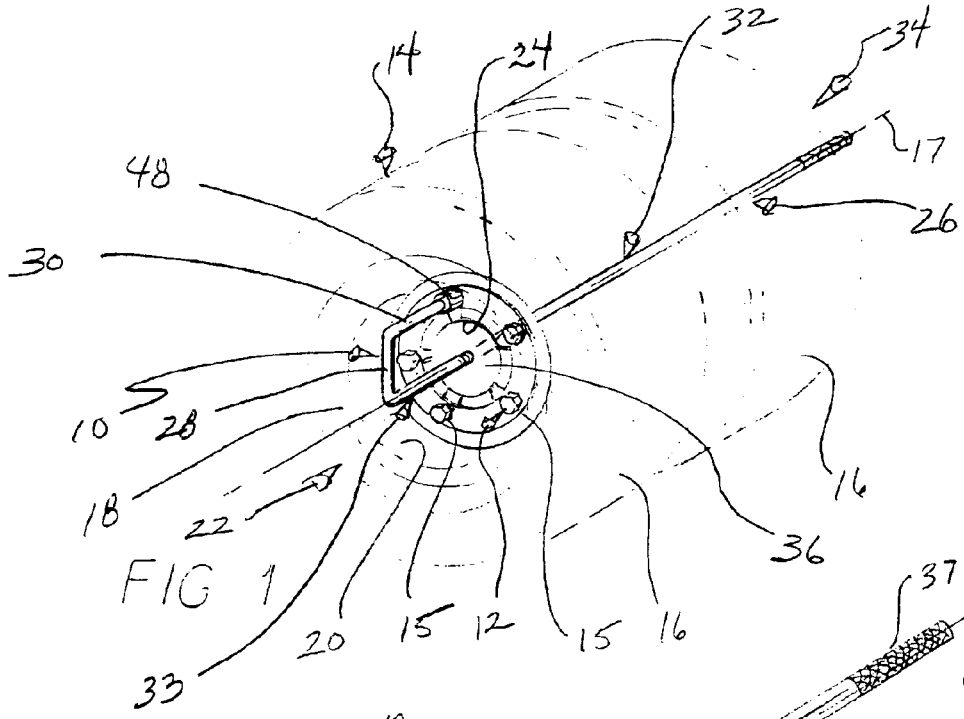
FIG. 1 is a perspective view of the tooling apparatus of the present invention being utilized on heavy duty truck and trailer wheels.

Referring to the drawings, the present invention will now be described in detail with reference to the disclosed embodiment.

Figure 2:
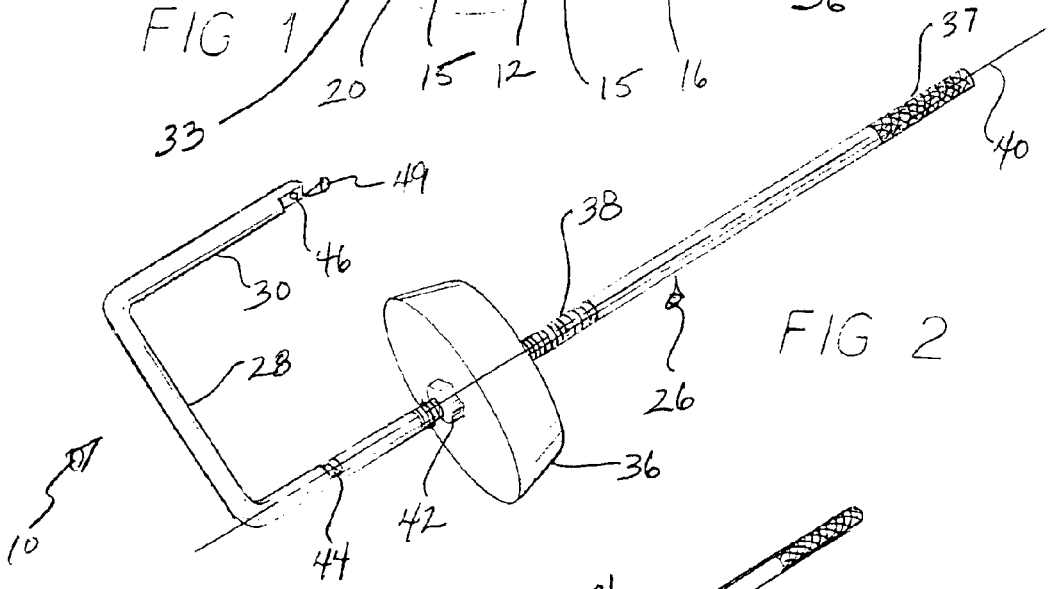
FIG. 2 is a perspective view showing a first embodiment of the tooling apparatus of the present invention.

FIGS. 1–2 illustrate a tooling apparatus 10 for aiding in the removal of brake drum bolts 12 on heavy duty truck or trailer wheels 14. The heavy duty truck or trailer wheels 14 provide a rubber tire 16 mounted on a rim 18. A brake drum 20 is mounted to a first side 22 of the wheels 14 and is connected to a spider (not shown) on a second side 34 of the wheels 14. The brake drum 20 is connected to the spider through five brake drum bolts 12. The brake drum bolts 12 include a threaded bolt (not shown) and a threaded nut 15 threaded thereon. The spider is connected to the rim 18 of the wheel 14 through a set of fasteners (not shown). The tooling apparatus 10 has a primary shaft 26, an intermediate shaft 28, and a secondary shaft 30. The primary shaft 26 extends through a hole 24 in the wheels 14 wherein the hole 24 is coaxially aligned with the center-line axis 17 of the wheels 14. A handle portion 32 of the primary shaft 26 extends on the second side 34 of the wheels 14, and the intermediate shaft 28, the secondary shaft 30, and a socket portion 33 of the primary shaft 26 are located on the first side 22 of the wheels 14. A bearing member 36 engages the hole or bearing race 24 in the wheels 14 and stabilizes the tooling apparatus 10 relative to the brake drum bolts 12. The bearing member 36 has a frusto-conical configuration so that the bearing member 36 may be wedged into the hole or bearing race 24 of the wheel 14. The bearing member 36 may be fabricated from nylon or a similar material such as a polymer or hardened rubber. The bearing member 36 should be fabricated from a "soft" rigid material so as not to damage the bearing face 24.

In order for the tooling apparatus 10 to engage the brake drum bolts 12, the tooling apparatus 10 has a substantially J-shaped configuration, as seen in FIG. 2. The primary shaft 26 provides the longer leg of the J-shaped configuration and has a knurled portion 37 on the loose end of the primary shaft 26. The knurled portion 37 provides a handle for a user to engage the tooling apparatus 10. The primary shaft 26 also has a threaded portion 38 extending along a substantially mid portion of the primary shaft 26. The threaded portion 38 threadably engages a threaded aperture in the bearing member 36 to adjustably position the bearing member 36 along a longitudinal axis 40 of the primary shaft 26. A pair of jam nuts 42 (only one shown) threadably engage the threaded portion 38 of the primary shaft 26 on each side of the bearing member 36 in order to secure the bearing member 36 in a predetermined position along the primary shaft 26 of the tooling apparatus 10. A groove 44 may be formed in one end of the primary shaft 26 to allow a pair of pliers (not shown) to grip the primary shaft 26 when loosening or tightening the jam nuts 42.

The intermediate shaft 28 is integral with and extends at a substantially right angle from the primary shaft 26 of the tooling apparatus 10. The intermediate shaft 28 extends at a radial distance substantially equivalent to the distance between the center-line axis of the wheels 14 and the brake drum bolts 12. The secondary shaft 30 is integral with and extends at a substantially right angle from the intermediate shaft 28 and is substantially parallel to and extends across from the primary shaft 26 of the tooling apparatus 10. A loose end 49 of the secondary shaft 30 has a substantially square configuration with a spring detent 46 formed therein for receiving a socket 48. The spring detent 46 may utilize a conventional design wherein common sockets 48 may be utilized to engage the nuts 15 of the brake drum bolts 12.

Figure 3:
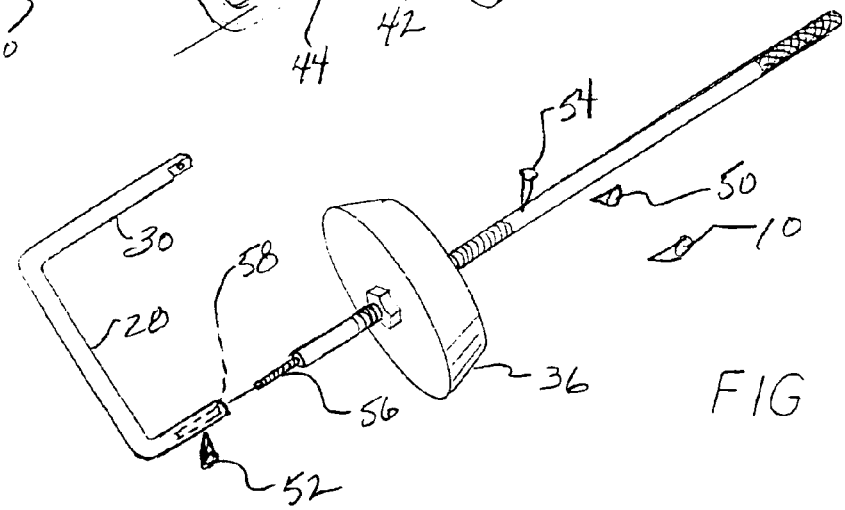
FIG. 3 is an exploded view of a second embodiment of the tooling apparatus of the present invention.

Since the radial distance between the center-line axis of the wheels 14 and the brake drum bolts 12 may vary depending on the size of the wheels, the tooling apparatus 10 may provide certain adjustments to vary the size of the tooling apparatus 10. As seen in FIG. 3, a second embodiment shows a primary shaft 50 having a socket portion 52 and a handle portion 54 that are releasably connected by a threaded stud 56 formed on the handle portion 54 of the primary shaft 50, and a threaded bore 58 formed in the socket portion 52 of the primary shaft 50 for receiving the threaded stud 56. This releasable connection allows various-sized socket portions 52 to be threaded onto the same primary shaft 50 in the event that various-sized wheels 14 are experienced.

Instead of interchanging different sized socket portions 52 of the tooling apparatus 10, the present invention provides that the intermediate shaft 28, the secondary shaft 30, and the primary shaft 26 of the tooling apparatus 10 may be adjustable with respect to one another. As seen in FIG. 4, the third embodiment of the present invention provides a primary shaft 60 having a T-shaped configuration. The longitudinal portion of the primary shaft 60 is similar to that disclosed in the first embodiment. The loose end of the primary shaft 60 has a knurled portion 37 to form a handle, and a mid portion of the primary shaft 60 has a threaded portion 38 for adjustably receiving the bearing member 36, similar to those previously described. A pair of jam nuts 42 are threaded on the primary shaft 60 on opposite sides of the bearing member 36 to secure the bearing member 36 in a predetermined position relative to the primary shaft 60. The lateral portion 62 of the T-shaped configuration of the primary shaft 60 has a threaded bore extending along a longitudinal axis of the lateral portion 62. The longitudinal axis of the lateral portion 62 is substantially perpendicular to the longitudinal axis of the longitudinal portion of the primary shaft 60. The threaded bore threadably receives an intermediate shaft 64 having threads formed thereon along the length of the intermediate shaft 64. A pair of jam nuts 66 may be threaded onto the intermediate shaft 64 on opposite sides of the lateral portion 62 of the T-shaped configuration of the primary shaft 60 so as to secure the intermediate shaft 64 in a predetermined position relative to the primary shaft 60.

The intermediate shaft 64 also provides an enlarged end 67 having a threaded bore extending therethrough. The threaded bore has a longitudinal axis substantially perpendicular to the longitudinal axis of the intermediate shaft 64. The threaded bore in the enlarged end 67 of the intermediate shaft 64 threadably receives a secondary shaft 68 wherein the secondary shaft 68 has threads formed along its outer diameter. A pair of jam nuts 70 may be threaded onto the secondary shaft 68 on both sides of the enlarged end 67 of the intermediate shaft 64 in order to secure the secondary shaft 68 in a predetermined position relative to the intermediate shaft 64. The end of the secondary shaft 68 provides a substantially square configuration and a spring detent 46 formed therein for receiving a socket 48, as previously described.

In yet another way to provide adjustment to the tooling apparatus 10, FIGS. 5–6 illustrate a fourth embodiment of the tooling apparatus 10. A primary shaft 72 has the knurled portion 37 for forming the handle as previously described, and the bearing member 36 is threadably received on a threaded portion of the primary shaft 72, as previously described. A pair of jam nuts 42 are utilized to lock the bearing member 36 into a predetermined position relative to the primary shaft 72, as also previously described. The primary shaft 72 has a T-shaped configuration wherein a lateral portion 74 of the T-shaped configuration has a throughbore 76 with a key way slot 77 extending along a longitudinal axis of the lateral portion 74 and substantially perpendicular to the longitudinal axis of the primary shaft 72. A slot 78 is also provided in a top portion of the lateral portion 74 whereby the slot 78 extends through to the bore 76. The bore 76 is smooth for receiving a smooth intermediate shaft 80 having a key 81 formed therein. The key 81 of the intermediate shaft 80 complimentarily engages the key way slot 77 in the lateral position 74. A fastener 82 threadably engages a pair of apertures provided in the top portion of the lateral portion 74 wherein the fastener 82 extends across the slot 78 formed in the upper portion of the lateral portion 74. The fastener 82 may tighten or loosen the grip of the lateral portion 74 of the primary shaft 72 on the intermediate shaft 80. The intermediate shaft 80 is integrally connected to a secondary shaft 84. The secondary shaft 84 has a longitudinal axis that is substantially perpendicular to the longitudinal axis of the intermediate shaft 80 and substantially parallel to the longitudinal axis of the primary shaft 72. The loose end of the secondary shaft 84 has the substantially squared configuration with a spring detent 46 formed therein for receiving a socket 48, as previously described in the first embodiment.

Yet another way to provide an adjustable connection to the tooling apparatus 10 is shown in FIGS. 7–8 as a fifth embodiment of the present invention. A primary shaft 86 provides the knurled portion 37 which acts as a handle, as previously described, and the threaded portion for threadably receiving the bearing member 36. The pair of jam nuts 42 may secure the bearing member 36 onto the primary shaft 86 in a predetermined position relative to the primary shaft 86. The primary shaft 86 provides a T-shaped configuration wherein a lateral portion 88 of the T-shaped configuration has a rectangular configuration with a substantially rectangular throughbore extending therethrough along a longitudinal axis of said lateral portion 88. An intermediate shaft 90 having a substantially rectangular cross section is inserted into and received by the rectangular throughbore in the lateral portion 88 of the primary shaft 86. A set screw 92 threads into a threaded aperture provided in the top wall of the lateral portion 88. The set screw 92 has its end engage the intermediate shaft 90 so as to secure the intermediate shaft 90 in a predetermined position relative to the lateral portion 88 on the end of the primary shaft 86. A secondary shaft 94 is integrally connected to the intermediate shaft 90 and has a longitudinal axis that extends at a substantially right angle to the longitudinal axis of said lateral portion 88 and substantially parallel to a longitudinal axis of said primary shaft 86. The loose end of the secondary shaft 94 has the substantially squared configuration with a spring detent 46 formed therein for receiving a socket 48, as described in the first embodiment of the present invention.

Figure 9:
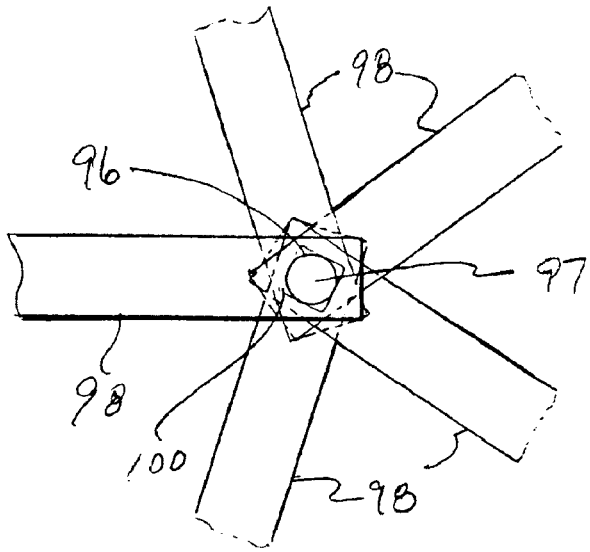
FIG. 9 is a fifth embodiment of the tooling apparatus of the present invention showing a plurality of intermediate shafts and secondary shafts connected to a primary shaft.

In order to engage all of the brake drum bolts 12 at one time, FIG. 9 shows a sixth embodiment utilizing five intermediate 98 shafts on a single primary shaft 96. The primary shaft 96 has the knurled portion 37 which acts as a handle and a threaded portion for threadably receiving the bearing member 36, as previously described in the first embodiment. Jam nuts 42 may be utilized to secure the bearing member 36 in a predetermined position relative to the primary shaft 96, as also previously described. The end of the primary shaft 96 provides a threaded stud 97 formed thereon. Five flat intermediate shafts 98 having an aperture extending therethrough are received by the threaded stud of the primary shaft 96. A nut 100 is threaded onto the threaded stud of the primary shaft 96 thereby securing the intermediate shafts 98 into a predetermined position corresponding to the configuration of the brake drum bolts 12. Each of the intermediate shafts 98 have an integral secondary shaft (not shown) extending at an angle substantially perpendicular to the intermediate shaft 98 and substantially parallel to the longitudinal axis of the primary shaft 96. Each of the secondary shafts has a substantially square end formed therein wherein the spring detent 46 is formed therein for receiving a socket 48, as described in the first embodiment of the present invention.

Figure 10:
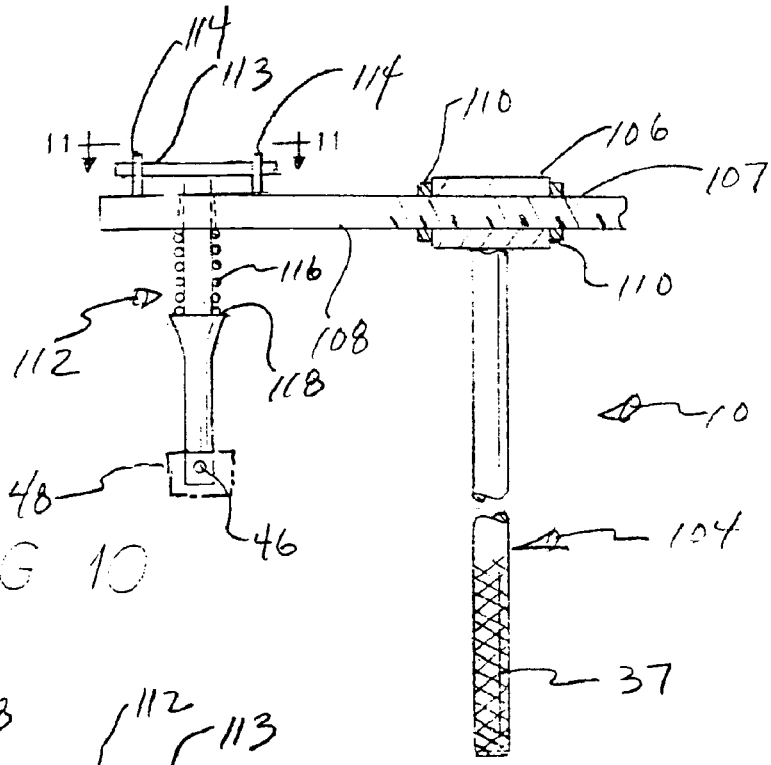
FIG. 10 is a sixth embodiment showing a rotational adjustment of the socket end of the tooling apparatus of the present invention.
Figure 11:
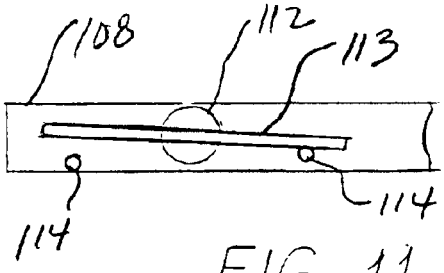
FIG. 11 is a partial top plan view of the tooling apparatus of the present invention shown in FIG. 10.

In order to provide rotational adjustment of the socket 48 onto the nut 15 of the brake drum bolts 12, FIG. 10 discloses a seventh embodiment of the tooling apparatus 10. A primary shaft 104 has a knurled portion 37 for forming a handle and a threaded portion formed thereon for threadably receiving the bearing member 36, as previously described. The jam nuts 42 secure the bearing member 36 onto the primary shaft 104 in a predetermined position, as also previously described. The primary shaft 104 provides a T-shaped configuration wherein the lateral portion 106 of the T-shaped configuration provides a threaded throughbore having a longitudinal axis substantially perpendicular to the longitudinal axis of the primary shaft 104. An intermediate shaft 108 has a threaded end 107 that is threadably received by the threaded throughbore in the lateral portion 106 of the primary shaft 104. A pair of jam nuts 110 are threaded onto the threaded portion of the intermediate shaft 108 on both sides of the lateral portion 106 to secure the intermediate shaft 108 into a predetermined position relative to the primary shaft 104.

The other end of the intermediate shaft 108 has a smooth diameter throughbore for receiving a smooth outer diameter of the secondary shaft 112. The secondary shaft 112 has a T-shaped configuration wherein the lateral portion 113 of the T-shaped configuration extends just above the intermediate shaft 108. A pair of diametrically opposed dowel rods 114 extend from the intermediate shaft 108 and act as positive stops to the lateral portion 113 of the T-shaped secondary shaft 112. The lateral portion 113 of the T-shaped secondary shaft 112 is positioned between the dowel rods 114 such that the secondary shaft 112 is allowed a limited degree of rotational movement for adjusting the socket 48 relative to the nut 15 of the brake drum bolts 12. A compression spring 116 is mounted on the secondary shaft 112 just below the intermediate shaft 108. A small shoulder 118 is formed on the secondary shaft 112 to support the lower portion of the compression spring 116. The upper portion of the compression spring 116 engages the underside of the intermediate shaft 108. The compression spring 116 biases the secondary shaft 112 downward such that the lateral portion 113 of the T-shaped configuration of the secondary shaft 112 may engage with the dowel rods 114. The end of the secondary shaft 112 has a substantially square configuration with the spring detent 46 formed therein for receiving the socket 48, as previously described in the first embodiment of the present invention.

In operation, as shown in FIGS. 1–2 of the first embodiment, the user or mechanic inserts the handle portion 32 of the primary shaft 26 through the hole or bearing face 24 of the truck or trailer wheels 14. The handle portion 32 of the primary shaft 26 remains on the second side 34 of the wheels 14, and the socket portion 52 of the tooling apparatus 10 remains on the first side 22 of the wheels 14. The proper-sized socket 48 for the nut 15 of the brake drum bolts 12 is determined by the mechanic and is attached to the spring detent 46 on the end of the secondary shaft 30. The bearing member 36 is wedged into the hole or bearing race 24 provided in the wheel 14, and the socket 48 is placed on the nut 15 of the brake drum bolts 12. If the socket 48 does not fit on the brake drum bolts 12, then the bearing member may be threadably adjusted along the primary shaft 26 to properly fit the socket 48 on the brake drum bolts. Once the bearing member 36 is properly adjusted, the mechanic stands on the second side of the wheels 14 and grasps the handle (knurled portion 37) of the primary shaft 26. The mechanic then utilizes an air ratchet or wrench to engage and loosen the bolts 13 of the brake drum bolts 12 on the second side 34 of the wheels 14. Once the brake drum bolts 12 are loosened, the mechanic moves to the first side 22 of the wheels 14 and places the socket 48 on a different nut 15 of the brake drum bolt 12. The process is repeated until all the brake drum bolts 12 are removed. A reverse procedure may be utilized to tighten the brake drum bolts 12 onto the brake drum 20.

While the invention has been described in connection with what is presently considered to be the most practical and preferred embodiment, it is to be understood that the invention is not to be limited to the disclosed embodiments, but to the contrary, it is intended to cover various modifications of equivalent arrangements included within the spirit and scope of the appended claims. The scope is to be accorded the broadest interpretation so as to encompass all such modifications and equivalent structures as is protected under the law.

What is claimed is:

1. A tooling apparatus for aiding in the removal of brake drum bolts on truck and trailer wheels, wherein said wheels have a hole coaxially aligned therewith, comprising:

an elongated primary shaft having a first end and a second end;

an intermediate shaft connected to said second end of said primary shaft;

a secondary shaft connected to said intermediate shaft, and said secondary shaft having a socket end adaptable to receive a socket for engaging said brake drum bolts; and a bearing member adjustably connected to said primary shaft and adaptable to engage said hole in said wheel for securing the position of said socket on said brake drum bolts.

2. The tooling apparatus stated in claim 1, further comprising:

said bearing member threadably engaging said primary shaft to allow for the adjustment of said bearing member along a longitudinal axis of said primary shaft.

3. The tooling apparatus stated in claim 1, further comprising:

said primary shaft, intermediate shaft, and secondary shaft integrally fabricated.

4. The tooling apparatus stated in claim 1, further comprising:

said first end and said second end of said primary shaft releasably connected to one another.

5. The tooling apparatus stated in claim 1, further comprising:

said intermediate shaft adjustably connected to said second end of said primary shaft.

6. The tooling apparatus stated in claim 1, further comprising:

said secondary shaft adjustably connected to said intermediate shaft.

7. The tooling apparatus stated in claim 5, further comprising:

said intermediate shaft threadably engaging said primary shaft; and at least one jam nut threadably engaging said intermediate shaft to secure said intermediate shaft in a predetermined position relative to said primary shaft.

8. The tooling apparatus stated in claim 5, further comprising:

said primary shaft having an aperture and key way formed therein for receiving said intermediate shaft; and said intermediate shaft having a key for cooperatively engaging said key way of said primary shaft.

9. The tooling apparatus stated in claim 5, further comprising:

said primary shaft having a substantially rectangular throughbore;

said intermediate shaft having a substantially rectangular cross-section;

said primary shaft receiving said intermediate shaft through said throughbore; and a set screw threadably engaging an aperture in said primary shaft wherein said set screw extends into said throughbore for engaging said intermediate shaft in a predetermined position relative to said primary shaft.

10. The tooling apparatus stated in claim 1, further comprising:

a plurality of said intermediate shafts and said secondary shafts mounted on said primary shaft.

11. The tooling apparatus stated in claim 1, further comprising:

said intermediate shaft having a throughbore for receiving said secondary shaft and allowing said secondary shaft to rotate;

at least one stop formed on said intermediate shaft; and said secondary shaft having a radially extending portion wherein said radially extending portion may engage said stop to limit the rotational adjustment of said secondary shaft.

12. A tooling apparatus for aiding in the removal of brake drum bolts on truck and trailer wheels, wherein said wheels have a hole coaxially aligned therewith, comprising:

an elongated, primary shaft having a first end and a second end;

an intermediate shaft connected to said second end of said primary shaft;

a secondary shaft connected to said intermediate shaft, and said secondary shaft having a socket end adaptable to receive a socket for engaging said brake drum bolts;

a frusto-conical bearing member threadably engaging said primary shaft for adjustment of said bearing member along a longitudinal axis of said primary shaft, and said bearing member adaptable to engage said hole in said wheel for securing the position of said socket on said brake drum bolts; and at least one jam nut threadably engaging said primary shaft and cooperatively engaging said bearing member to secure said bearing member in a predetermined position relative to said primary shaft.

13. The tooling apparatus stated in claim 12, further comprising:

said bearing member fabricated from a nylon material.

14. The tooling apparatus stated in claim 12, further comprising:

said primary shaft, intermediate shaft, and secondary shaft integrally fabricated.

15. The tooling apparatus stated in claim 12, further comprising:

said first end of said primary shaft having a knurled portion formed therein for forming a handle on said primary shaft.

16. The tooling apparatus stated in claim 12, further comprising:

said first end and said second send of said primary shaft releasably connected to one another.

17. The tooling apparatus stated in claim 12, further comprising:

said primary shaft having a threaded bore extending therethrough;

said intermediate shaft threadably engaging said bore of said primary shaft for adjustment along a longitudinal axis of said intermediate shaft; and at least one jam nut threadably engaging said intermediate shaft to secure said intermediate shaft in a predetermined position relative to said primary shaft.

18. The tooling apparatus stated in claim 12, further comprising:

said primary shaft having an aperture and a key way for receiving said intermediate shaft;

said intermediate shaft having a key for cooperatively engaging said key way of said primary shaft; and said primary shaft having a slot and a threaded fastener extending across said slot to secure said intermediate shaft within said primary shaft.

19. The tooling apparatus stated in claim 12, further comprising:

said primary shaft having a substantially rectangular throughbore;

said intermediate shaft having a substantially rectangular cross-section;

said primary shaft receiving said intermediate shaft through said throughbore; and a set screw threadably engaging an aperture in said primary shaft for engaging said intermediate shaft in a predetermined position relative to said primary shaft.

20. The tooling apparatus stated in claim 12, further comprising:

a plurality of said intermediate shafts and said secondary shafts connected to said primary shaft.

21. The tooling apparatus stated in claim 12, further comprising:

said intermediate shaft having a throughbore for receiving said secondary shaft and allowing said secondary shaft to rotate about its longitudinal axis;

a pair of rods extending from said intermediate shaft; and said secondary shaft having a substantially T-shaped configuration wherein said lateral leg of said T-shaped configuration may engage said rods to limit the rotational adjustment of said secondary shaft.

* * * * *

UNITED STATES PATENT AND TRADEMARK OFFICE

CERTIFICATE OF CORRECTION

PATENT NO. : 6,952,865 B2
DATED : October 11, 2005
INVENTOR(S) : Fransted

It is certified that error appears in the above-identified patent and that said Letters Patent is hereby corrected as shown below:

Column 4,
Lines 18 and 28, insert -- 17 -- after “axis”;
Line 30, insert -- 14 -- after “wheels”;

Column 7,
Line 31, insert -- 36 -- after “member”;
Line 33, insert -- 12 -- after “bolts”;
Line 35, insert -- 34 -- after “side”; and Column 9,
Line 35, delete “send”, and insert -- end --.

Signed and Sealed this

Fourteenth Day of February, 2006

JON W. DUDAS
*Director of the United States Patent and Trademark Office*